United States Patent [19]

Henderson

[11] 4,166,517

[45] Sep. 4, 1979

[54] PILOT'S POWER ELEVATOR

[76] Inventor: Chuck A. Henderson, 12300 39th Ave., Kenosha, Wis. 53142

[21] Appl. No.: 867,017

[22] Filed: Jan. 5, 1978

[51] Int. Cl.[2] ..... D66B 11/00; B63B 27/16

[52] U.S. Cl. ..... 187/6; 9/1.6; 114/270; 414/138; 414/140

[58] Field of Search ..... 187/6; 114/270; 214/13, 214/15 R; 9/1.6, 1.7

[56] References Cited

U.S. PATENT DOCUMENTS

| | | | |
|---|---|---|---|
| 1,587,979 | 6/1926 | Nelson | 214/15 R |
| 2,841,246 | 7/1958 | Lamb | 187/6 |
| 4,055,139 | 10/1977 | Scheiding | 114/270 |

FOREIGN PATENT DOCUMENTS

| | | | |
|---|---|---|---|
| 2044091 | 3/1972 | Fed. Rep. of Germany | 114/270 |
| 488171 | 12/1953 | Italy | 114/270 |
| 1113570 | 5/1968 | United Kingdom | 9/1.6 |

*Primary Examiner*—Robert B. Reeves
*Assistant Examiner*—Jeffrey V. Nase
*Attorney, Agent, or Firm*—Neil E. Hamilton

[57] ABSTRACT

An elevator apparatus mounted on a side of a ship, for allowing a pilot to board or disembark from the ship; the apparatus including a vertical track, extending from the water up to the bridge, an elevator, supported by a cable from a davit upon the bridge, being movable vertically along the track, the elevator having a door on its outer side, for access from a pilot's boat, and a door on an opposite side, for entering the ship bridge, controls and lights upon the bridge and in the elevator, and a flotation tank under the elevator, for supporting the same upon the water surface.

5 Claims, 9 Drawing Figures

LIGHT ON BRIDGE
LIGHT IN ELEVATOR
POWER
TANK
SWITCH OPERATED BY WATER PRESSURE AUTOMATICALLY

CONTROL ON BRIDGE
CONTROL IN ELEVATOR
ELEVATOR DRIVE ENGINE

PILOT'S POWER ELEVATOR

This invention relates generally to apparatus installed upon ships. More specifically, it relates to elevators mounted upon a ship.

A principal object of the present invention is to provide an elevator, which can be installed on an outer side of a ship, so as to permit a pilot to board or disembark from a large ship.

Another object of the invention is to provide a pilot's power elevator, which will serve to carry a pilot from a pilot's small boat up to a ship's bridge which may be four stories high.

Yet a further object is to provide a pilot's power elevator, which can be conveniently entered by a pilot from the pilot boat, and from which he can enter directly upon the ship bridge, thereby eliminating the necessity for the pilot to be exposed, walking up unprotected stairways or gangplanks.

Other objects are to provide a pilot's power elevator, which is simple in design, inexpensive to manufacture, rugged in construction, easy to use and efficient in operation.

These, and other objects, will be readily evident, upon a study of the following specification, and the accompanying drawing, wherein.

Figures 1, 2, 3, 4, 5, 6, 7, 8, 9:
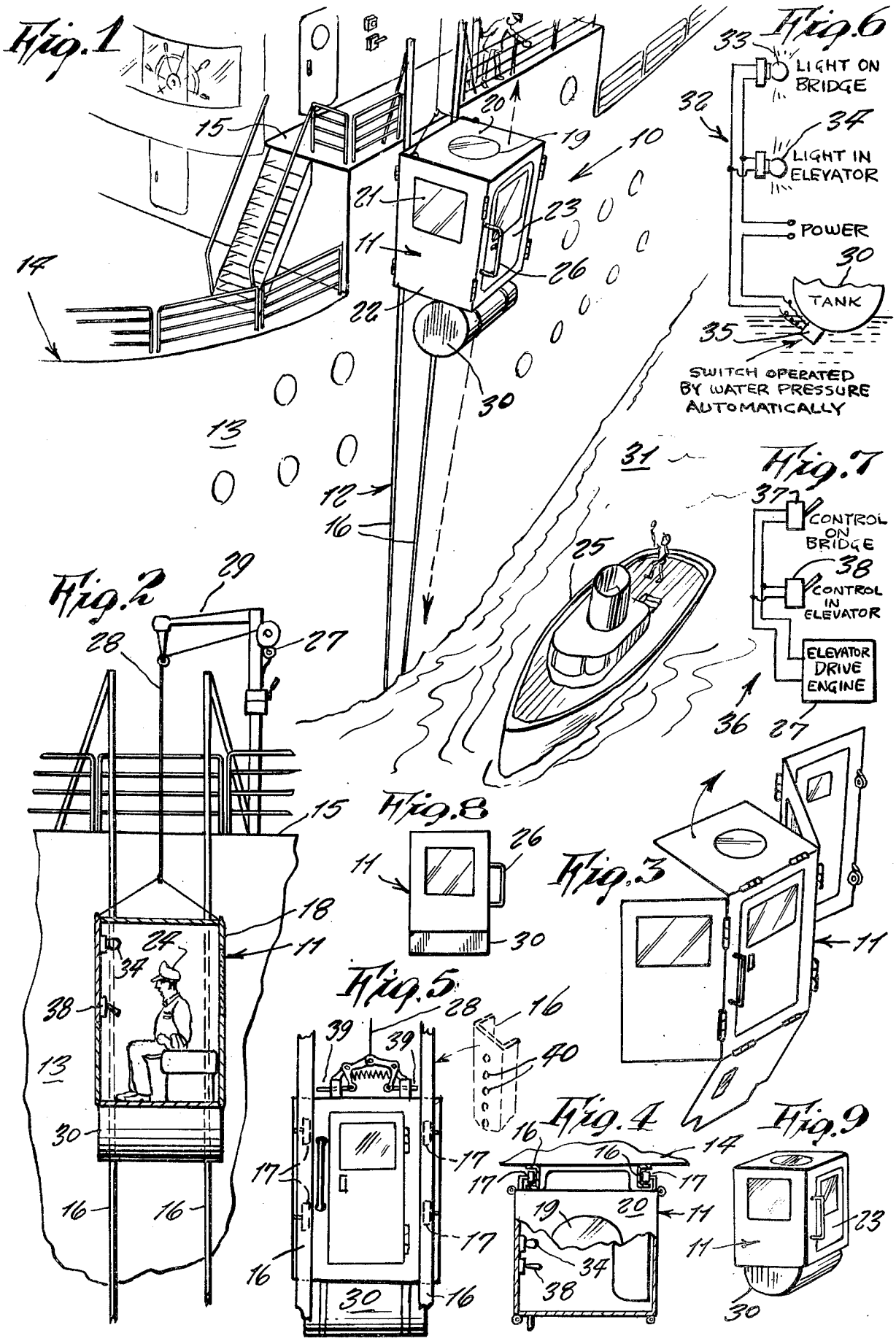
FIG. 1 is a perspective view of the invention, shown in vertical travel alongside a ship hull.
FIG. 2 is a front view thereof, with the elevator cab shown in cross-section.
FIG. 3 illustrates the elevator cab being collapsed for storage.
FIG. 4 is a top view of the elevator cab, shown partly in cross-section.
FIG. 5 is a rear view of the elevator cab, and illustrating a modified design of suspension, which automatically locks the cab to the rails, in case the winch cable breaks, so as to prevent the elevator from falling.
FIG. 6 illustrates diagrammatically a light indicator system for the elevator.
FIG. 7 illustrates diagrammatically a control system for the elevator.
FIG. 8 is a side view of an elevator, having a flat tank fitted against its underside.
FIG. 9 is a perspective view of an elevator, having a half-barrel shaped tank mounted on its underside.

Referring now to the drawing in greater detail, the reference numeral 10 represents a pilot's power elevator, according to the present invention, wherein there is an elevator cab 11, which is vertically able to travel along a track 12, that is mounted on the outer side 13 of a large ship 14. The ship may be of a large size, such as a four story high container ship, so that a bridge 15 thereof may be located possibly forty feet high above a water level.

In the present invention, the track 12 comprises a pair of rails 16, which, at their lower ends, extend below the water level, and which, at its upper end, extend up to the bridge. Each rail may be channel-shaped, so that wheels 17 of the elevator cab cannot disengage from the rails while travelling up and down.

The cab comprises a box-like enclosure 18, having a window 19 on its roof 20, as well as windows 21 on opposite side walls 22 thereof. Additionally, opposite sides of the cab include doors 23, one of which faces outwardly, so that a pilot 24 can enter therethrough, from a small pilot boat 25, while a door on the opposite side permits the pilot to step out of the elevator, and upon the bridge 15. A grab handle 26, on the cab, serves to steady the pilot as he steps between the boat 25 and the elevator. The elevator cab is powered vertically up and down along the rails, by means of an electrically operated winch 27, for reeling or unreeling a cable 28, which is secured to the upper end of the elevator cab. The winch and cable are mounted upon a davit 29, the davit being mounted upon the bridge.

A flotation tank 30 is mounted on the underside of the elevator cab, and serves to stop the vertical descent of the elevator cab, when it comes into engagement with the sea water 31. The tank may be cylindrical in shape, as shown in FIGS. 1, 2, 5 and 6, or it may be flat and square-shaped, as shown in FIG. 8, or else semi-cylindrical, as shown in FIG. 9. In any situation, it should be approximately two feet thick, and it can be fastened to the elevator, by means of hinges in a preferred form. This will satisfy the safety standards of the Coast Guard and other experts. Alternately, the flat square shaped tank could be attached to the bottom of the elevator, by electro magnets along the bottom of the elevator. The hinge-type attachment method would be on a pivot system, that locks into place when connected. The flotation tank is filled with air, and a pressure gauge insures that the proper air pressure is contained therewithin.

As clearly shown in FIG. 6, the present apparatus includes a light indicator system 32, with a light 33 upon the bridge, and a light 34 in the elevator, and which are connected to a power source, as well as a switch 35 mounted on the underside of the tank, where it can be operated by the water pressure automatically, so that the lights 33 and 34 will readily tell the pilot inside the cab, when the cab has reached the water level during a descent. Additionally, the apparatus includes a control system 36, shown in FIG. 7, and which includes a control 37 on the bridge, and a control 38 in the elevator, for powering the winch 27. The lights should be amber colored. Control panels in the elevator, and on the bridge, should include flashing lights with arrows pointing up, as well as down, and instructions should be printed alongside in English, Spanish and German. The arrow indicating the lights comprise travel lights, and may be in a green color.

As shown in FIG. 3, the elevator cab is readily collapsible for storage. In FIG. 5, locking pins 39 automatically engage openings 40 in the rails, in case the cable 28 breaks, thus providing a safety to the apparatus.

While various changes may be made in the detail construction, it is understood that such changes will be within the spirit and scope of the present invention, as is defined by the appended claims.

What I now claim is:

1. A pilot's power elevator, comprising in combination: a vertical track mounted on an outside of a tall ship, said track comprising a pair of rails extending from below a water level up to a bridge, an elevator cab guided by, directly mounted on and vertically movable along said rails, winch means mounted on said bridge, a cable operatively connected to said winch means and said cab to raise and lower said cab along said rails, and flotation means secured adjacent the underside of said cab.

2. The combination as set forth in claim 1 wherein said winch is electrically operated and mounted on a davit, and said flotation means is secured to the underside of said elevator cab and comprises a flotation tank hingedly secured thereto.

3. The combination as set forth in claim 2, wherein a light indicator system of said elevator includes a light on said bridge, and a light in said elevator, connected to a power source, and a switch on an underside of said tank, which is operated automatically by water pressure.

4. The combination as set forth in claim 3, wherein said elevator includes a control system, including a control on said bridge, and a control in said elevator.

5. The combination as set forth in claim 1 wherein said cab is defined by panel members hinged at adjacent edges so as to be completely collapsible.

* * * * *